United States Patent [19]

Geremia

[11] Patent Number: 4,518,832

[45] Date of Patent: May 21, 1985

[54] ROTARY AND/OR PUSH-PULL WIPING SWITCH

[75] Inventor: Leo F. Geremia, Wallingford, Conn.

[73] Assignee: Haydon Switch & Instrument, Inc., Waterbury, Conn.

[21] Appl. No.: 526,032

[22] Filed: Aug. 24, 1983

[51] Int. Cl.[3] ..... H01H 1/18; H01H 9/00; H01H 13/00; H01H 21/80

[52] U.S. Cl. ..... 200/4; 200/6 B; 200/14; 200/153 L; 200/164 R; 200/241

[58] Field of Search ..... 200/4, 5 R, 14, 17 R, 200/18, 16 B, 16 E, 153 L, 153 LB, 164 A, 164 R, 165, 237–243, 6 B, 6 BA, 6 BB

[56] References Cited

U.S. PATENT DOCUMENTS

| | | | |
|---|---|---|---|
| 2,402,173 | 6/1946 | Malone | 200/165 |
| 2,451,224 | 10/1948 | Johnson | 200/4 |
| 3,040,142 | 6/1962 | Dietrich et al. | 200/16 A X |
| 3,277,413 | 10/1966 | Kropp et al. | 335/206 |
| 3,493,696 | 2/1970 | Rothweiler | 200/14 X |
| 3,649,793 | 3/1972 | MacLean | 200/153 H |
| 3,892,934 | 7/1975 | Richards et al. | 200/243 X |
| 4,001,740 | 1/1977 | MacLean | 335/73 |
| 4,103,132 | 7/1978 | Schwarzkopf | 200/241 X |
| 4,106,072 | 8/1978 | MacLean | 361/156 |
| 4,121,073 | 10/1978 | Bileski et al. | 200/243 |
| 4,133,020 | 1/1979 | MacLean | 361/166 |
| 4,255,733 | 3/1981 | MacLean | 335/190 |

FOREIGN PATENT DOCUMENTS

| | | |
|---|---|---|
| 746642 | 3/1956 | United Kingdom . |
| 1104218 | 2/1968 | United Kingdom . |
| 1276026 | 6/1972 | United Kingdom . |
| 1304277 | 1/1973 | United Kingdom . |
| 2036439 | 8/1983 | United Kingdom . |

*Primary Examiner*—J. R. Scott

*Attorney, Agent, or Firm*—Lee C. Robinson, Jr.

[57] ABSTRACT

A switch assembly of the rotary and/or push-pull type is made up of a plurality of stacked switch section including rotary switch sections and/or push-pull switch sections, all actuated by a common central shaft. In the rotary sections, there are at least one pair of terminals, a rotary cam rotatable with the shaft, a substantially rigid cam follower contact arm biased against the rotary cam and movable, with rotation of the cam, between open and closed positions. The contact arm is hinged on and electrically connected with one of the pair of terminals. The other end of the contact arm has a dog-leg section and a resilient conductive leaf, favorably formed of beryllium-copper, on which a movable contact is mounted. The flexing of the leaf brings about wiping action of the movable contact when it closes onto a fixed contact connected with the other terminal. The push-pull switch sections have an axially movable carrier also including a flexible resilient leaf member on which movable contacts are mounted. The movable contacts of the push-pull switching sections also close with a wiping action on their mating fixed contacts.

15 Claims, 11 Drawing Figures

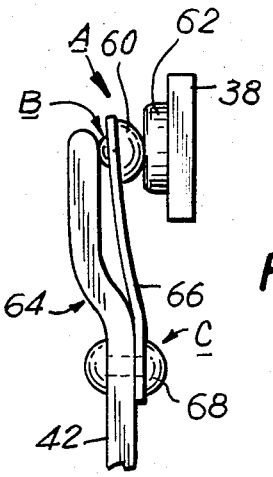
FIG.4a
FIG.4
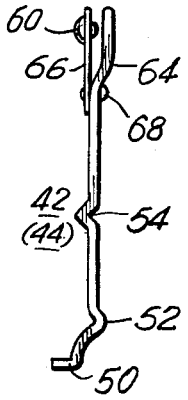
FIG.5
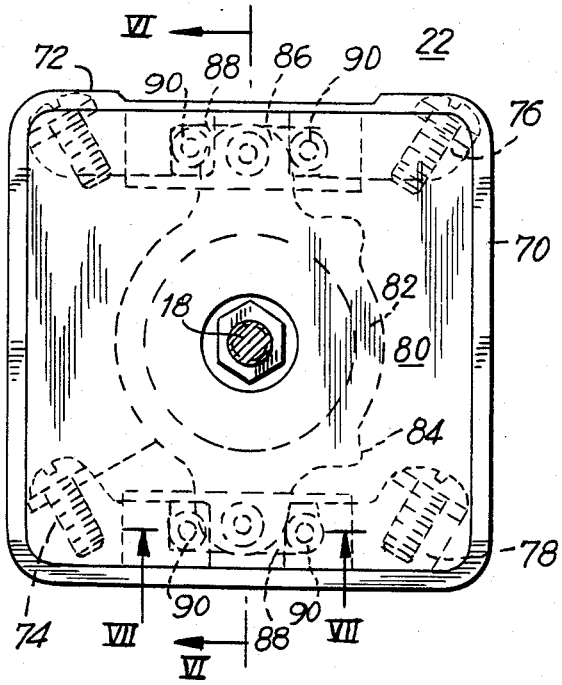
FIG.6
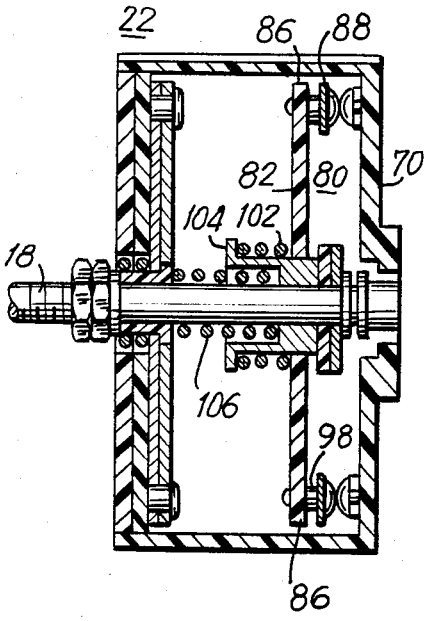
FIG.7
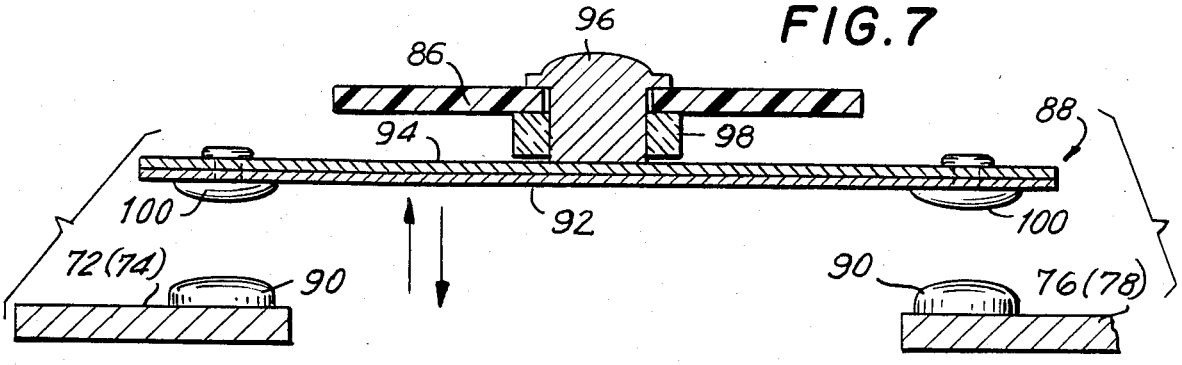

FIG. 8
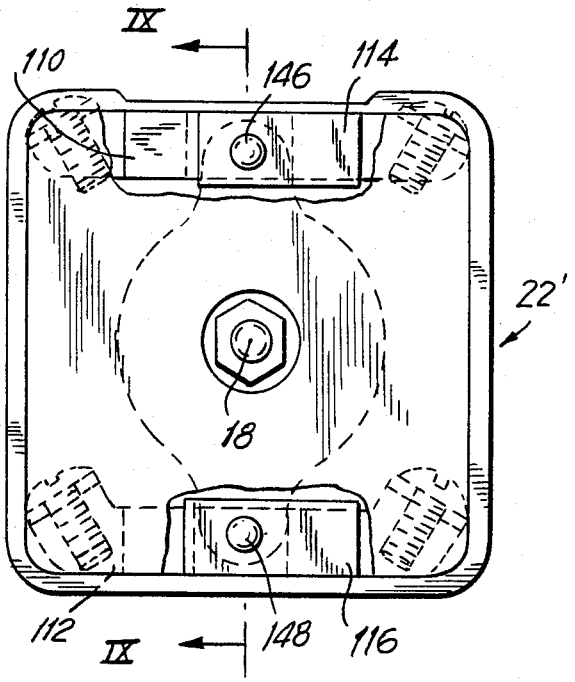
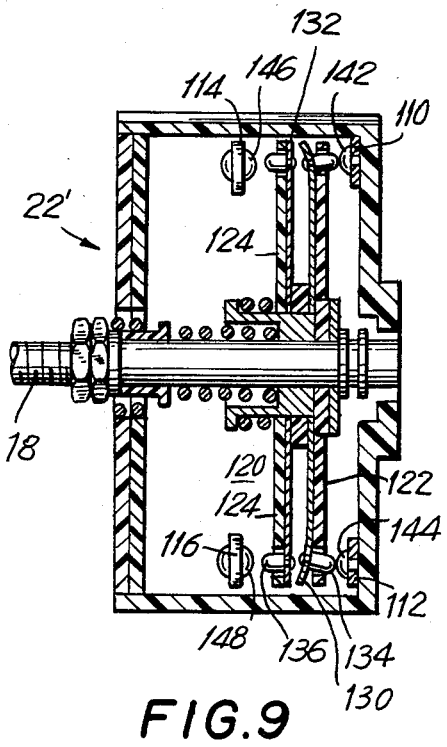
FIG. 9
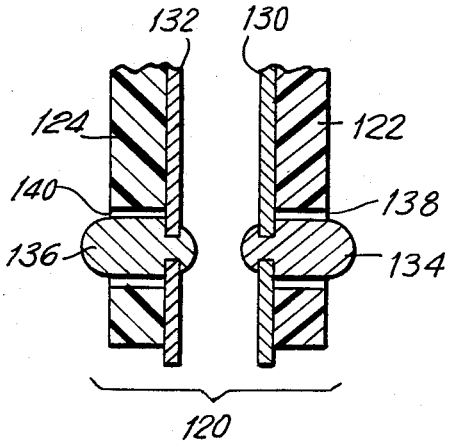
FIG. 10

ROTARY AND/OR PUSH-PULL WIPING SWITCH

This invention relates to switching devices, and is particularly directed to two-position switching devices of the rotary or push-pull type in which a stack of switching sections are actuated by a common selector hub.

Control switches of the general type herein described are well known, and many types thereof are used, for example, in electrical utilities or in large power production stations, for example, for controlling a power distribution system. Such control switches are usually panel-mounted in groups associated onto power control panels. Such groups are each formed of a stack of switch sections, each of which has at least two fixed contacts and two movable contacts. A handle shaft or hub extends centrally through the stack of switch sections, and has either a handle actuator thereon for manual actuation, or a rotary solenoid or other means for electrical actuation.

Generally, the control switch arrangement is of a combined rotary and push-pull type, including some rotary sections and some push-pull sections. The rotary sections are arranged to open or close by rotating the control hub approximately 45° , while the push-pull sections are arranged to assume one of an open and closed state when the control hub is pulled out, and to assume the other state when the control hub is pushed in.

Because of the environment in which these control switches are employed, high currents can generally be expected to flow through the switch contacts when the respective switch sections are closed. However, the construction of the contacts and actuator members within the presently available types of rotary and push-pull switch sections is such that the fixed and movable contacts move in one dimension, i.e., an up-down fashion only. That is, because the movable contact is conventionally affixed solidly on an inflexible actuator member, the movable contact and fixed contact of each switching section move toward and away from each other in only one dimension. As a result of this action, the contacts strike each other abruptly upon closing, and there is often noticeable arcing and pitting of the contacts after only a short term of use.

If a wiping action were incorporated into the rotary and push-pull switch sections, the closing of the fixed and movable contacts would occur more smoothly and with a marked reduction in arcing and pitting. However, it has previously been considered impractical to include any provision for wiping action in a conventional type of rotary or push-pull switch section of such a control switch arrangement.

Accordingly, it is an object of this invention to provide a control switch of the rotary and/or push-pull type which avoids the above-mentioned problems of the prior art, and which effects closing of the fixed and movable contacts thereof with a wiping action.

It is another object of this invention to provide such a control switch having improved contact conductance, and having reduced arcing and pitting of the contact members thereof.

In accordance with several of the multitude of possible embodiments of this invention, a switch assembly is provided of the combined rotary and push-pull type, in which there are a plurality of stacked switch sections, including at least one rotary switch section and at least one push-pull switch section. These stacked switch sections are actuated by a common central shaft or hub, passing through these sections and being rotatable and displaceable axially, at least to a limited extent, to change the on/off state of the rotary and push-pull switch sections, respectively. The at least one rotary section includes one or more pairs of terminals, a rotary cam rotatable with the shaft, a substantially rigid cam follower contact arm biased against the rotary cam and movable, with rotation of the cam between opened and closed positions, with the contact arm having one end electrically connected with one of the pair of terminals, and another end. The other end of the contact arm has a movable contact member disposed thereon to contact a fixed contact member electrically connected to the other of the pair of terminals when the contact arm is in its closed position. The at least one push-pull switch section includes at least one pair of terminals and an insulating carrier member disposed to move axially with the shaft between open and closed positions, and a pair of movable contact members mounted on the carrier to contact corresponding fixed contact members that are electrically coupled to the terminals, these contact members mating when the carrier member is in its closed position.

According to the improvement of this invention, the other end of the cam follower contact arm includes a flexible resilient conductor leaf, with the contact member of the contact arm being mounted on the leaf. Similarly, the carrier member of the push-pull switch section includes a flexible resilient conductive leaf mounting each of the movable contacts associated with the carrier member. As a result of this structure, whenever the shaft is rotated and/or displaced to bring the cam follower contact arm and/or the carrier member to the closed position thereof, bending of the associated leaf member, as the mating fixed and movable contact members close, causes the respective movable contact member to close with its mating fixed contact member with a wiping action.

In one preferred embodiment, the contact arm is formed of a stiff copper material, and the distal end thereof is formed as a dog-leg section. The resilient conductive leaf includes a strip of beryllium copper affixed onto the arm in advance of the dog-leg section so as to be parallel thereto but normally separated therefrom. The movable contact member is preferably a domed silver contact, and is favorably mounted at the distal end of the beryllium-copper strip.

In other preferred embodiments, the flexible leaf of the push-pull carrier member is disposed on a nose of the carrier member, and acts to bridge a pair of fixed contacts when the carrier member is in its closed position. Preferably, this leaf includes a beryllium-copper strip mounted on and displaced axially from the carrier member, and the movable contact members are disposed at ends of the strip. This beryllium-copper strip can be formed of two or more layers, and is favorably mounted, at a central portion thereof, by means of a pedestal mounting on the carrier member.

In still other preferred embodiments, the carrier member can include a pair of insulating support plates disposed axially apart from each other and carrying respective flexible resilient conductive leaves on facing sides thereof. The movable contact members can include two pairs of contact members with each such pair being mounted on a respective one of the conductive leaves. The movable contact members can extend through apertures in the associated insulating plate, with a clearance being provided around the contacts. Closing pressure on the contacts causes them to be deflected inwards, and to roll and effect a wiping action. The two resilient flexible conductive leaves can be shorted together.

In all of these embodiments, as well as in many others besides, the mounting of the movable contact on the beryllium-copper or other flexible conductive leaf permits the fixed and movable contacts to roll or "wipe" against each other when the contacts close together. This results because the leaf, which acts as a flexing member, adds a degree of freedom to the movement of the movable contact. The mating of the movable contact with its associated fixed contact is more gradual than with the conventional arrangement, thereby resulting in smoother make and break for each activation. This yields an improvement in less arcing and less contact pitting. Consequently, the contacts have a greater life expectancy.

The above and many further objects, features, and advantages of this invention will be more fully understood by considering the ensuing detailed description of a preferred embodiment thereof, which is to be considered in connection with the accompanying drawings, in which.

FIGS. 4 and 4*a* show a contact arm of the rotary switch section, constructed according to the present invention.

FIGS. 5 and 6 are rear and side sectional views of a push-pull switching section according to an embodiment of this invention.

FIG. 7 is a sectional view taken along the line VII—VII of FIG. 5.

FIGS. 8 and 9 are rear and side sectional views of another push-pull switching section according to the present invention.

Figure 1:
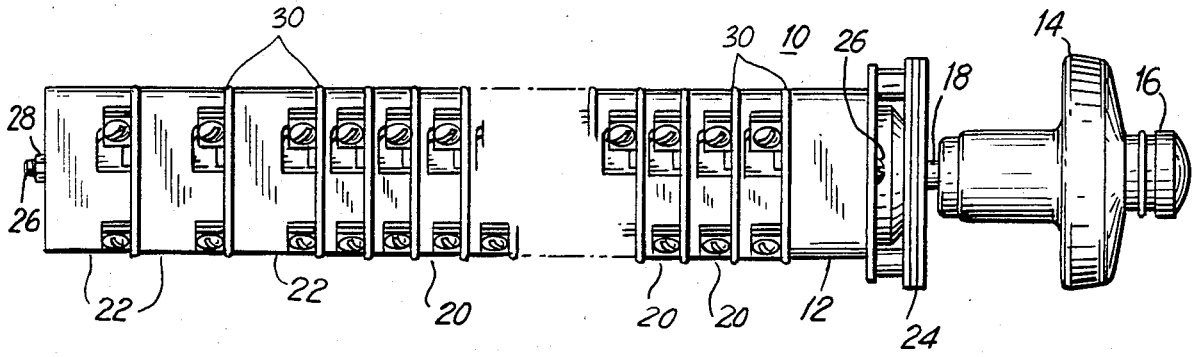
FIG. 1 is a side view of a combined rotary and push-pull switch arrangement, incorporating the improvements of this invention.

FIG. 10 is an enlarged fragmentary sectional view of a portion of the embodiment of FIG. 9. With reference now to the drawings, and initially to FIG. 1 thereof, a rotary/push-pull switch assembly 10 is seen to include a head section 12, which can be of conventional design, and a handle 14 having a locking knob 16, which is pushed or squeezed to release the handle 14. A central hub or shaft 18, having square or hexagonal cross section, is affixed to the handle 14, and extends through the head 12. A plurality of rotary switch sections 20 and push-pull switch sections 22 are stacked together on the switching head 12. An end plate 24 is disposed over the head section 12, and several spindles 26 extend from the end plate 24 through the head section 12 and also through the stack of rotary sections 20 and push-pull sections 22. These spindles 26 are secured by nuts 28. Gaskets 30 separate the successive switching sections 20 and 22 from one another.

Figure 2:
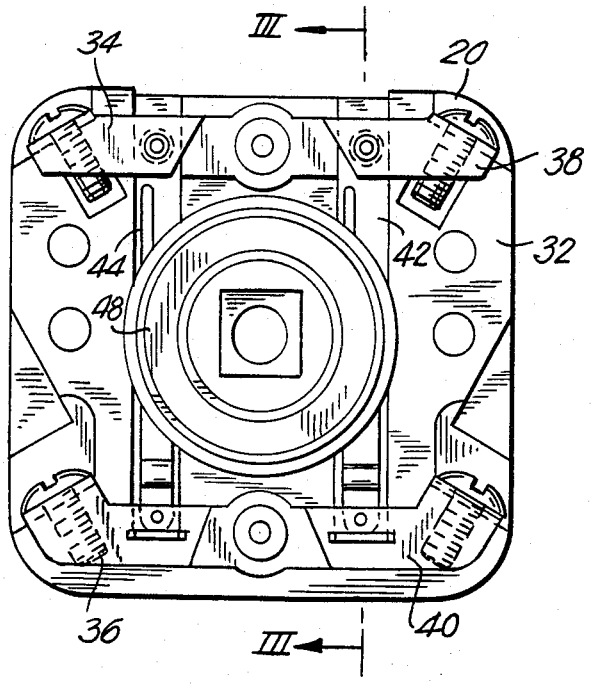
FIGS. 2 and 3 are rear and side sectional views, respectively, of a rotary switch section according to an embodiment of this invention.
Figure 3:
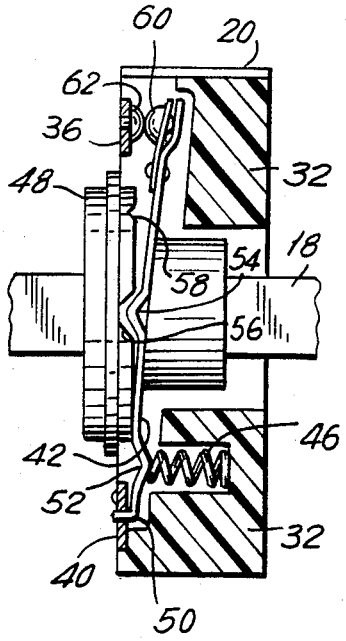

As shown in FIGS. 2 and 3, each of the rotary switching sections 20 is formed of a plastic insulating housing 32 with four terminals 34, 36, 38, 40 accessible from the sides of the switching section 20. First and second contact arms 42 and 44 extend respectively from the lower terminals 36, 40 to the upper terminals 34, 38, respectively. These arms 42 and 44 are preferably formed of stiff copper plated with silver. As shown better in Figure 3, a spring 46 biases the associated contact arm 42 or 44 into a closed position. A rotor cam 48 is mounted on the shaft 18 to rotate over an angle, e.g., of 45° , for camming the contact arms 42 and 44 between open and closed positions thereof.

With reference to FIG. 4, the contact arms 42 and 44 each have a foot 50 disposed to hinge in a slot in a contact bar forming a part of the respective lower terminals 36 and 40, and a knee 52 against which the spring 46 is disposed. A cam elbow 54 coacts with first and second detents 56, 58 in the rotor cam 48. The detent 56 is cut lower than the other detent 58, and thus corresponds to the closed position of the contact arm 42 or 44. The other detent 58 serves to releasably hold the arm 42 or 44 in its open position.

A movable contact member 60 at the distal end of the arm 42 or 44, mates with a corresponding fixed contact 62 disposed on a contact bar forming a part of the corresponding upper terminal 34 or 38.

As shown in FIG. 4, unlike conventional devices, in this embodiment of the present invention, the distal end of the arm 42 or 44 has an offset or dog-leg section 64. A beryllium-copper flexible conductive strip or leaf 66 is mounted by a rivet 68 in advance of the dog-leg section 64, and the contact 60 is mounted at an end of this flexible strip or leaf 66. Here, the contact 60 is domed, and is preferably formed of fine silver.

Because of the flexing action of the leaf 66, the contacts 60 and 62 close together with a rolling or wiping action. That is, as the contacts 60 and 62 close, the angle of impact between these contacts 60, 62 changes. The result of this is that these contacts 60, 62 roll over each other, at least slightly, so that the closing pressure of the movable contact 60 onto the fixed contact 62 is not always directed to the same spot, as of course is the case with the conventional design in which contact movement is limited to one dimension.

Also, as shown in FIG. 4A, in addition to the contact point A between the contacts 60 and 62, there is also the further contact point B where the reverse side of the contact 60 touches with the dog-leg section 64, and thence to the point C where the arm 42 or 44 and the leaf 66 are joined. This results in current flowing through two current paths ABC and AC, thereby reducing the net contact resistance.

As shown in FIGS. 5 and 6, the push-pull switching sections 22 can be formed of a housing 70 (approximately two times the thickness of the housing 32 for the rotary sections 20), and also having four terminals 72, 74, 76, and 78. A plunger mechanism 80 is adapted to move forward and back with axial movement of the shaft 18, but not to move with rotation thereof. The plunger mechanism includes an insulating plate member 82 having a pair of protuberances 84 to prevent rotation within the housing 70. The plate member 82 also has a pair of noses 86 disposed at positions 180° apart, relative to the hub or shaft 18.

A pair of contact wing members 88 are disposed one on each of the noses 86. These contact wing members 88 mate with contact members 90 each coupled to one of the upper terminal members 72 and 76 or one of the lower terminal members 74 and 78. As shown in FIG. 7, each contact wing member 88 is formed of two layers 92 and 94 of flexible beryllium copper coextensine with each other, and is mounted at a central portion thereof onto the nose 86 by means of a rivet 96. A spacer 98 serves as a pedestal to space the contact wing member 88 a predetermined distance from the plate member 82. Movable contacts 100 are mounted at opposite sides of the member 88 to mate with the fixed contacts 90. These contacts 100 are favorably domed, and formed of fine silver.

As the plate member 82 moves axially to bring the movable contacts 100 to mate with the fixed contacts 90, the flexing of the contact wing members 88 serves to give the contacts 90, 100 a wiping action as they close together.

Returning to FIG. 6, the plunger mechanism 80 of the push-pull switching section 22 is also seen to include a sleeve 102 on which the plate 82 is mounted, with a spring 104 biasing the plate 82 with respect to the sleeve 102, and a spring 106 biasing the sleeve 102 with respect to the housing 70. This arrangement provides overtravel protection.

An alternative form of the push-pull switching section 22′ will now be explained with reference to FIGS. 8 and 9. In this switching section 22′ one set of upper and lower terminals 110, 112 is mounted within one side of a housing 70′, while another set of upper and lower terminals 114, 116, is mounted within the other side of the housing 70′.

A push-pull plunger mechanism 120 includes a first stiff insulating plate member 122 and a second stiff insulating plate member 124 spaced somewhat apart from each other. Each of these members 122, 124 has a respective cladding of conductive material on the facing surfaces thereof and shorted together.

As is perhaps better shown in FIG. 10, at least a portion of the claddings are formed as beryllium-copper resilient flexible leaves 130 and 132, respectively. At each of the upper and lower ends of the plate members 122, 124 are disposed a pair of domed, silver contacts 134 and 136, mounted respectively on the beryllium-copper leaves 130 and 132. Apertures 138 and 140 are provided in the insulating plate members 122 and 124, with sufficient clearance for free movement of the contacts 134 and 136 therethrough. The beryllium-copper leaves 130 and 132 are biased against their associated plate members 122 and 124, but are not affixed against, and are free to flex away from the plate members 122 and 124 when the movable contacts 134 and 136 are moved into a closed position with respect to the mating contacts 142, 144, 146, 148 disposed in electrical contact with the terminals 110, 112, 114, and 116, respectively. In this switch section 22′ the contacts 142 and 144 are disposed to the front of the plunger mechanism 120, while the other contacts 146 and 148 are disposed rearward thereof.

It will be observed by those skilled in the art that the rotary and push-pull switching sections incorporating the improvements of the present invention can be arranged as simple on-off switches, make before break transfer switches, or various other types of switches depending upon their internal configuration.

It is also apparent that the switching sections 20, 22, and 22′ of the invention, or any of various equivalents thereof, can be retrofitted onto to existing switching arrangements to improve the performance thereof.

The rotary switching sections can be arranged as single pole rotate-to-break switches, double pole make-before-break in one direction, or make-before-break in both directions. Also, by shunting a number of these switching sections 20 together, the circuit can be made to close in both directions.

Further with the push-pull switching sections 22 or 22′, there can be configured push-to-break/pull-to-make; push-to-make/pull-to-make; double pull push-to-make; double pole push-to-break; or pull-to-make/push-to-break switches.

While the present invention has been described with reference to an exemplary preferred embodiment, it is to be understood that the invention is certainly not limited thereto, and that many modifications and variations would become apparent to those skilled in the art without departing from the scope and spirit of this invention, as defined in the appended claims.

I claim:

1. In a switch assembly of the rotary type in which there are a plurality of stacked switch sections, including at least one rotary switch section, which are actuated by a common central shaft passing through said sections and being rotatable, at least to a limited extent, to change the state of said at least one rotary switching section; in which said at least one rotary section includes at least one pair of terminals, a rotary cam rotatable with said shaft, a substantially rigid cam follower contact arm biassed against said rotary cam and movable, with rotation of said cam, between open and closed positions, said contact arm having one end electrically connected with one of said pair of terminals and another end, said other end having a movable contact member disposed thereon to contact a fixed contact member electrically connected to the other of said pair of terminals when said contact arm is in its closed position; the improvement wherein each said cam follower contact arm has attached at an end thereof flexible resilient conductive leaf means, with the associated contact member of said contact arm being mounted on said leaf means; such that whenever said shaft is rotated to bring said cam follower contact arm to the closed position thereof, bending of the associated leaf member causes the respective movable contact member to close with its mating fixed contact member with a wiping action.

2. In a switch assembly of the rotary type in which there are a plurality of stacked switch sections, including at least one rotary switch section, which are actuated by a common central shaft passing through said sections and being rotatable, at least to a limited extent, to change the state of said at least one rotary switching section; in which said at least one rotary section includes at least one pair of terminals, a rotary cam rotatable with said shaft, a substantially rigid cam follower contact arm biassed against said rotary cam and movable, with rotation of said cam, between open and closed positions, said contact arm having one end electrically connected with one of said pair of terminals and another end, said other end having a movable contact member disposed thereon to contact a fixed contact member electrically connected to the other of said pair of terminals when said contact arm is in its closed position, wherein said contact arm is formed as a strip of stiff copper material; the improvement wherein said other end of said cam follower contact arm strip is formed as a dog-leg section and further includes a flexible resilient leaf formed of a strip of beryllium copper affixed onto said arm in advance of said dog-leg section so as to be normally separated therefrom, with the contact member being mounted on said leaf; such that whenever said shaft is rotated to bring said cam follower contact arm to the closed position thereof, bending of the associated leaf member causes the respective movable contact member to close with its mating fixed contact member with a wiping action.

3. A switch assembly as recited in claim 2, wherein said movable contact member is a domed silver contact mounted at a distal end of said beryllium-copper strip.

4. In a switch assembly of the push-pull type in which there are a plurality of stacked switch sections, including at least one push-pull switch section, which are actuated by a common central shaft passing through said sections and being displaceable axially, at least to a limited extent, to change the state of said at least one push-pull switching section; and in which said at least one push-pull switch section includes at least one pair of terminals and an insulating carrier member disposed to move axially with said shaft between open and closed positions, and a pair of movable contact members mounted on said carrier to contact corresponding fixed contact members electrically coupled to said terminals when said carrier member is in its closed position; the improvement wherein said carrier member of said at least one push-pull switch section includes flexible resilient conductive leaf means spaced axially from said carrier member and mounting each of the movable contacts associated with said carrier member; such that whenever said shaft is displaced to bring said carrier member to the closed position thereof, bending of the associated leaf means causes the respective movable contact member to close with its mating fixed contact member with a wiping action.

5. In a switch assembly of the push-pull type in which there are a plurality of stacked switch sections, including at least one push-pull switch section, and which are actuated by a common central shaft passing through said sections and being displaceable axially, at least to a limited extent, to change the state of said at least one push-pull switch section includes at least one pair of terminals and an insulating carrier member disposed to move axially with said shaft between open and closed positions, and a pair of movable contact members mounted on a radially extending nose on said carrier to contact and bridge together corresponding fixed contact members electrically coupled to said terminals when said carrier member is in its closed position; the improvement wherein said carrier member of said at least one push-pull switch section includes a flexible resilient conductive leaf formed of a strip of flexible conductive material mounted on said nose of said carrier and displaced axially therefrom, with said movable contact members being disposed at ends of said strip; such that whenever said shaft is displaced to bring said carrier member to the closed position thereof, bending of the associated leaf causes the associated movable contact members to close with their mating fixed contact members with a wiping action.

6. A switch assembly as recited in claim 5, wherein said flexible conductive material is beryllium copper.

7. A switch assembly as recited in claim 5, wherein said strip is formed of two coextensive layers, with said movable contact being mounted on said two-layer strip.

8. A switch assembly as recited in claim 5, further including a pedestal mounting said strip, at a central portion thereof, onto said nose of said carrier member and maintaining the axial displacement of said strip relative to said carrier member.

9. In a switch assembly of the push-pull type in which there are a plurality of stacked switch sections, including at least one push-pull switch section, which are actuated by a common central shaft passing through said sections and being displaceable axially, at least to a limited extent, to change the state of said at least one push-pull switching section; and in which said at least one push-pull switching section includes at least one pair of terminals and an insulating carrier member disposed to move axially with said shaft between open and closed positions, and a pair of movable contact members mounted on said carrier to contact corresponding fixed contact members electrically coupled to said terminals when said carrier member is in its closed position; wherein said carrier member includes a pair of insulating support plates disposed axially apart from each other and carrying respective conductive leaves on facing sides thereof, with said movable contact members including two pairs of contact members with each such pair electrically coupled to a respective one of said leaves, and extending through apertures in the associated insulating plate; the improvement wherein said conductive leaves are formed of resiliently flexible material and are deflectable away from their associated insulating support plates, with the movable contacts being affixed onto said leaves and free to move through said apertures, such that whenever said shaft is displaced to bring said carrier member to a closed position thereof, bending of the associated leaf causes the respective movable contact members to close with their mating fixed contact members with a wiping action.

10. A switch assembly as recited in claim 9, wherein the resilient flexiable conductive leaves mounted on the facing sides of said insulating plates are shorted together.

11. In a switch assembly of the push-pull type in which there are a plurality of stacked switch sections, including at least one push-pull switch section, and which are actuated by a common central shaft passing through said sections and being displaceable axially, at least to a limited extent, to change the state of said at least one push-pull switching section; and in which said at least one push-pull switching section includes at least one pair of terminals and an insulating carrier member disposed to move axially with said shaft between open and closed positions, and a pair of movable contact members mounted on said carrier to contact corresponding fixed contact members electrically coupled to said terminals when said carrier member is in its closed position; wherein said carrier member includes a pair of insulating support plates disposed axially apart from each other and carrying respective conductive leaves on facing sides thereof, with said movable contact members including two pairs of contact members with each such pair electrically coupled to a respective one of said leaves and extending through apertures in the associated insulating plate; the improvement wherein said conductive leaves are formed of resiliently flexible beryllium-copper material and are deflectable away from their associated insulating support plates, with the movable contacts being affixed onto said leaves and free to move through said apertures, such that whenever said shaft is displaced to bring said carrier member to a closed position thereof, bending of the associated leaf causes the respective movable contact members to close with their mating fixed contact members with a wiping action.

12. A switch assembly as recited in claim 11, wherein said movable contact members are domed and are formed of silver.

13. In a switch assembly of the combined rotary and push-pull type in which there are a plurality of stacked switch sections, including at least one rotary switch section and at least one push-pull switch section, and which are actuated by a common central shaft passing through said sections and being rotatable and displaceable axially, at least to a limited extent, to change the state of said rotary and push-pull switching sections, respectively; in which said at least one rotary section includes at least one pair of terminals, a rotary cam rotatable with said shaft, a substantially rigid cam follower contact arm biassed against said rotary cam and movable, with rotation of said cam between open and closed positions, said contact arm having one end electrically connected with one of said pair of terminals and another end, said other end having a movable contact member disposed thereon to contact a fixed contact member electrically connected to the other of said pair of terminals when said contact arm is in its closed position; and in which said at least one push-pull switch section includes at least one pair of terminals and an insulating carrier member disposed to move axially with said shaft between open and closed positions, and a pair of movable contact members mounted on said carrier to contact corresponding fixed contact members electrically coupled to said terminals when said carrier member is in its closed position; the improvement wherein said other end of said cam follower contact arm includes a flexible resilient conductive leaf, with the contact member of said contact arm being mounted on said leaf; and wherein said carrier member of said push-pull switch section includes a flexible resilient conductive leaf mounting each of the movable contacts associate said carrier member that whenever said shaft is rotated and/or the respective one of displaced to bring axially said cam follower contact arm and said carrier member to the closed position thereof, bending of the associated leaf member causes the respective movable contact member to close with its mating fixed contact member with a wiping action.

14. In a switch assembly of the combined rotary and push-pull type in which there are a plurality of stacked switch sections, including at least one rotary switch section and at least one push-pull switch section and which are actuated by a common central shaft passing through said sections and being rotatable and displaceable axially, at least to a limited extent, to change the state of said rotary and push-pull switching sections, respectively; in which said at least one rotary section includes at least one pair of terminals, a rotary cam rotatable with said shaft, a substantially rigid cam follower contact arm biassed against said rotary cam and movable, with rotation of said cam between open and closed positions, said contact arm being formed as a strip of stiff copper material and having one end electrically connected with one of said pair of terminals and another end, said other end having a movable contact member disposed thereon to contact a fixed contact member electrically connected to the other of said pair of terminals when said contact arm is in its closed position; and in which said at least one push-pull switch section includes at least one pair of terminals and an insulating carrier member disposed to move axially with said shaft between open and closed positions, and a pair of movable contact members mounted on said carrier to contact corresponding fixed contact members electrically coupled to said terminals when said carrier member is in its closed position; the improvement wherein said other end of said cam follower contact strip is formed as a dog-leg section and further includes a flexible resilient conductive leaf formed of a strip of beryllium-copper affixed onto said arm in advance of said dog-leg section so as to be normally separated therefrom, with the moving contact member of said contact arm being mounted on said leaf; and wherein said carrier member of said push-pull switch section includes a flexible resilient conductive leaf member formed of beryllium-copper mounting each of the movable contacts associated with said carrier member; such that whenever said shaft is rotated and/or axially displaced to bring the respective one of said cam follower contact arm and said carrier member to the closed position thereof, bending of the associated leaf causes the respective movable contact member to close with its mating fixed contact member with a wiping action.

15. A switch assembly as recited in claim 14, wherein said movable contact member of said rotary switch section is a domed silver contact mounted at a distal end of said beryllium-copper strip, and said movable members of said push-pull switch section are domed silver contacts mounted on said leaf member.

* * * * *